US009564096B2

(12) United States Patent
Hwang et al.

(10) Patent No.: US 9,564,096 B2
(45) Date of Patent: Feb. 7, 2017

(54) METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: Samsung Display Co., Ltd., Yongin, Gyeonggi-do (KR)

(72) Inventors: Jun-Ho Hwang, Asan-si (KR); Young-Sun Kwak, Cheonan-si (KR); Ki-Hyun Pyun, Goyang-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 218 days.

(21) Appl. No.: 14/061,663

(22) Filed: Oct. 23, 2013

(65) Prior Publication Data

US 2014/0347258 A1 Nov. 27, 2014

(30) Foreign Application Priority Data

May 27, 2013 (KR) ..... 10-2013-0059437

(51) Int. Cl.
*G09G 3/36* (2006.01)

(52) U.S. Cl.
CPC ..... *G09G 3/3677* (2013.01); *G09G 2310/06* (2013.01); *G09G 2320/0219* (2013.01)

(58) Field of Classification Search
CPC ..... G06F 3/36–3/3696; G09G 2320/0219; G09G 2310/06
See application file for complete search history.

(56) References Cited

U.S. PATENT DOCUMENTS

| | | | | |
|---|---|---|---|---|
| 7,924,255 | B2 * | 4/2011 | Hsu | G09G 3/3648 345/100 |
| 8,044,914 | B2 | 10/2011 | Lee et al. | |
| 8,373,729 | B2 | 2/2013 | Lee et al. | |
| 2011/0221983 | A1 | 9/2011 | Lee et al. | |
| 2012/0038610 | A1 * | 2/2012 | Li et al. | 345/211 |

FOREIGN PATENT DOCUMENTS

| | | | |
|---|---|---|---|
| KR | 10-2007-0014561 | A | 2/2007 |
| KR | 10-2008-0034542 | A | 4/2008 |
| KR | 10-2009-0019106 | A | 2/2009 |

* cited by examiner

*Primary Examiner* — Matthew Sim
(74) *Attorney, Agent, or Firm* — Knobbe Martens Olson & Bear LLP

(57) ABSTRACT

A display panel driving apparatus is disclosed. In one aspect the apparatus includes a gate driving part and a data driving part. The gate driving part is configured to increase a gate signal applied to a gate line of a display panel from an OFF voltage to a ON voltage, in response to an activation of a gate clock signal. It is also configured to decrease the gate signal from the ON voltage to a kickback compensation voltage between the OFF voltage and the ON voltage through a plurality of steps in response to an activation of a kickback compensation signal. The data driving part is configured to apply a data signal to a data line of the display panel. Therefore, a data-charging rate may be increased, and thus a display quality of the display apparatus may be increased.

16 Claims, 6 Drawing Sheets

METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

CROSS-REFERENCE TO RELATED APPLICATIONS

This application claims priority under 35 U.S.C. §119 to Korean Patent Application No. 10-2013-0059437, filed on May 27, 2013 in the Korean Intellectual Property Office (KIPO), the contents of which are herein incorporated by reference in their entireties.

BACKGROUND

Field

The present disclosure generally relates to a method of driving a display panel, a display panel driving apparatus performing the method and a display apparatus having the display panel driving apparatus. More particularly, the disclosed technology relates to a method of driving a display panel used in a display apparatus, a display panel driving apparatus performing the method and a display apparatus having the display panel driving apparatus.

Description of the Related Technology

A display panel of a display apparatus, such as a liquid crystal display apparatus, generally includes a gate line, a data line, a switching element electrically connected to the gate line and the data line, and a pixel electrode electrically connected to the switching element.

A gate signal applied to the gate line is usually transited from a gate-off voltage (or OFF voltage) to a gate-on voltage (or ON voltage) during a horizontal period, the switching element is turned on in response to an activation of the gate signal, and thus a data signal applied to the data line is charged to the pixel electrode.

The gate signal is typically transited from the ON voltage to the OFF voltage after the horizontal period, the switching element is turned off in response to an inactivation of the gate signal, and thus the data signal is not charged to the pixel electrode.

When the gate signal is inactivated, a kickback voltage is usually generated due to a parasitic capacitance of the switching element, and the kickback voltage often deteriorates a display quality of the display apparatus.

A technique for inserting a kickback compensation period when the gate signal is decreased from the ON voltage to a kickback compensation voltage (or compensation voltage) greater than the OFF voltage in a period when the gate signal is decreased from the ON voltage to the OFF voltage has been developed, so as to decrease the kickback voltage.

However, when the kickback compensation voltage is decreased and the kickback compensation period is increased so as to decrease the kickback voltage, a data-charging rate regarding a data signal charged to the pixel electrode is decreased and thus the display quality of the display apparatus is deteriorated.

SUMMARY OF CERTAIN INVENTIVE ASPECTS

One inventive aspect of the described technology is a method of driving a display panel capable of increasing a display quality of a display apparatus.

Another inventive aspect of the described technology is a display panel driving apparatus performing the above-mentioned method.

Another inventive aspect of the described technology is a display apparatus having the above-mentioned display panel driving apparatus.

According to an example embodiment of the described technology there is provided a method of driving a display panel. In the method, a gate signal applied to a gate line of the display panel is increased from an OFF voltage to a ON voltage in response to an activation of a gate clock signal. The gate signal is decreased from the ON voltage to a kickback compensation voltage between the OFF voltage and the ON voltage through a plurality of steps in response to an activation of a kickback compensation signal.

In one exemplary embodiment, the gate signal may be decreased by decreasing the gate signal from the ON voltage to a first kickback compensation voltage that is greater than the OFF voltage and decreasing the gate signal from the first kickback compensation voltage to a second kickback compensation voltage between the OFF voltage and the first kickback compensation voltage.

In one exemplary embodiment, the gate signal may be decreased to the first kickback compensation voltage by responding to an activation of a first kickback compensation signal.

In one exemplary embodiment, the gate signal may be decreased to the second kickback compensation voltage by responding to an activation of a second kickback compensation signal different from the first kickback compensation signal.

In one exemplary embodiment, the first kickback compensation signal and the second kickback compensation signal may be sequentially activated.

In one exemplary embodiment, the second kickback compensation signal may be activated as soon as the first kickback compensation signal is inactivated.

In one exemplary embodiment, the second kickback compensation signal may be inactivated in response to an inactivation of the gate clock signal.

In one exemplary embodiment, the first kickback compensation signal may be activated before the gate clock signal is inactivated.

According to another exemplary embodiment of the described technology, a display panel driving apparatus includes a gate driving part and a data driving part. The gate driving part is configured to increase a gate signal applied to a gate line of a display panel from an OFF voltage to an ON voltage, in response to an activation of a gate clock signal. The gate driving part is also configured to decrease the gate signal from the ON voltage to a kickback compensation voltage between the OFF voltage and the ON voltage through a plurality of steps in response to an activation of a kickback compensation signal. The data driving part is configured to apply a data signal to a data line of the display panel.

In one exemplary embodiment, the gate driving part may include a first kickback voltage compensation part configured to decrease the gate signal from the ON voltage to a first kickback compensation voltage greater than the OFF voltage, and a second kickback voltage compensation part configured to decrease the gate signal from the first kickback compensation voltage between the OFF voltage and the first kickback compensation voltage.

In one embodiment, the first kickback voltage compensation part may decrease the gate signal from the ON voltage to the first kickback compensation voltage in response to an activation of a first kickback compensation signal.

In one embodiment, the second kickback voltage compensation part may decrease the gate signal from the first kickback compensation voltage to the second kickback compensation voltage in response to an activation of a second kickback compensation signal different from the first kickback compensation signal.

In one embodiment, the first kickback compensation signal and the second kickback compensation signal may be sequentially activated.

In one embodiment, the second kickback compensation signal may be activated as soon as the first kickback compensation signal is inactivated.

In one embodiment, the second kickback compensation signal may be inactivated in response to an inactivation of the gate clock signal.

In one embodiment, the display panel driving apparatus may further include a timing control part (or timing controller) configured to output the gate clock signal, the first kickback compensation signal and the second kickback compensation signal.

In one embodiment, the first kickback compensation signal may be activated before the gate clock signal is inactivated.

According to still another example embodiment of the described technology, a display apparatus includes a display panel and a display panel driving apparatus. The display panel is configured to receive a data signal to display an image. The display panel driving apparatus includes a gate driving part configured to increase a gate signal applied to a gate line of the display panel from an OFF voltage to an ON voltage in response to an activation of a gate clock signal and decrease the gate signal from the ON voltage to a kickback compensation voltage between the OFF voltage and the ON voltage through a plurality of steps in response to an activation of a kickback compensation signal, and a data driving part configured to apply a data signal to a data line of the display panel.

In one embodiment, the gate driving part may include a first kickback voltage compensation part configured to decrease the gate signal from the ON voltage to a first kickback compensation voltage greater than the OFF voltage, and a second kickback voltage compensation part configured to decrease the gate signal from the first kickback compensation voltage between the OFF voltage and the first kickback compensation voltage.

In one embodiment, the first kickback voltage compensation part may decrease the gate signal from the ON voltage to the first kickback compensation voltage in response to an activation of a first kickback compensation signal. The second kickback voltage compensation part may decrease the gate signal from the first kickback compensation voltage to the second kickback compensation voltage in response to an activation of a second kickback compensation signal following the first kickback compensation signal.

According to an inventive aspect of the described technology, a gate signal is decreased from a ON voltage to a first kickback compensation voltage in response to an activation of a first kickback compensation signal. In addition, the gate signal is decreased from the first kickback compensation voltage to a second kickback compensation voltage in response to an activation of a second kickback compensation signal. Therefore, the gate signal is decreased from the ON voltage to a kickback compensation voltage through two steps in a kickback compensation period. Therefore, a data-charging rate may be increased, and thus a display quality of the display apparatus may be increased.

BRIEF DESCRIPTION OF THE DRAWINGS

The above and other features and advantages of the described technology will become more apparent by describing in detailed example embodiments thereof with reference to the accompanying drawings, in which.

DETAILED DESCRIPTION OF CERTAIN INVENTIVE EMBODIMENTS

Hereinafter, the described technology will be explained in detail with reference to the accompanying drawings.

Figure 1:
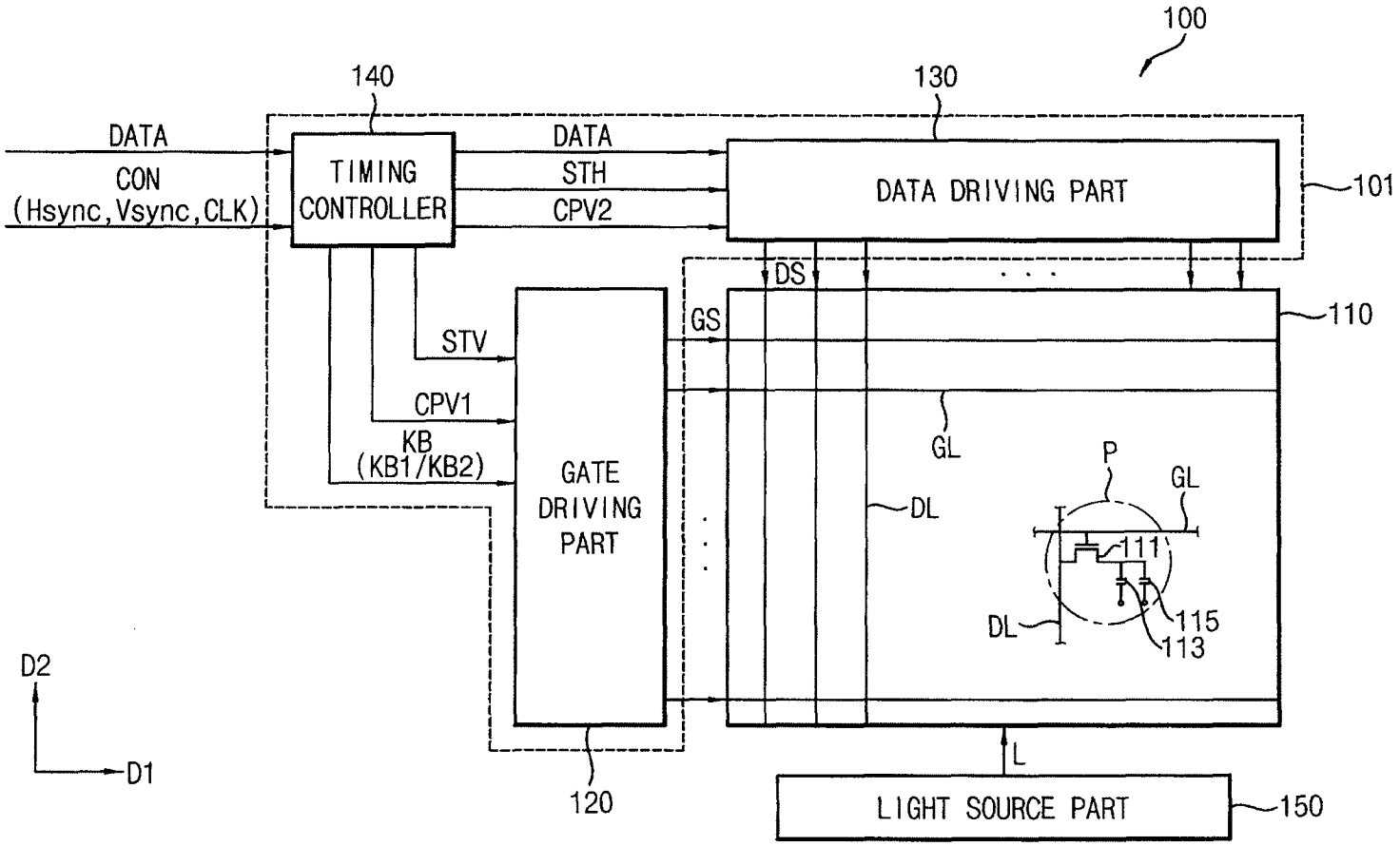
FIG. 1 is a block diagram illustrating a display apparatus according to an example embodiment of the described technology.

FIG. 1 is a block diagram illustrating a display apparatus according to an exemplary embodiment of the described technology.

Referring to FIG. 1, the display apparatus 100 according to the present exemplary embodiment includes a display panel 110 and a display panel driving apparatus 101.

The display penal 110 receives a data signal DS, based on an image data DATA, to display an image. For example, the image data DATA may be two-dimensional plane image data. Alternatively, the image data DATA may include a left-eye image data and a right-eye image data for displaying a three-dimensional stereoscopic image.

The display panel 110 includes gate lines GL, data lines DL and a plurality of pixels P. The gate line GL extends in a first direction D1 and the data line DL extends in a second direction D2 substantially perpendicular to the first direction D1. The first direction D1 may be parallel with a long side of the display panel 110 and the second direction D2 may be parallel with a short side of the display panel 110. Each of the pixels P includes a thin-film transistor 111 electrically connected to the gate line GL and the data line DL, a liquid crystal capacitor 113 and a storage capacitor 115 connected to the thin-film transistor 111.

The display panel driving apparatus 101 includes a gate driving part 120, a data driving part 130 and a timing controller 140.

The gate driving part 120 generates a gate signal GS in response to a gate start signal STV and a gate clock signal CPV1 provided from the timing controller 140, and outputs the gate signal GS to the gate line GL. Specifically, the gate driving part 120 increases the gate signal GS from an OFF voltage to a ON voltage in response to activations of the gate start signal STV and the gate clock signal CPV1. In addition, the gate driving part 120 decreases the gate signal GS from the ON voltage to the OFF voltage in response to an inactivation of the gate clock signal CPV1. For example, the OFF voltage may be about −7.5 volts (V) to about −6.5 volts (V), and the ON voltage may be about 28 volts (V) to about 31 volts (V).

In addition, the gate driving part 120 decreases the gate signal GS from the ON voltage to a kickback compensation voltage greater than the OFF voltage in response to a kickback compensation signal KB provided from the timing controller 140. Specifically, the gate driving part 120 decreases the gate signal GS from the ON voltage to the kickback compensation voltage before the gate clock signal CPV1 is inactivated. The gate driving part 120 may decrease the gate signal GS to the kickback compensation voltage through a plurality of steps. For example, the gate driving part 120 may decrease the gate signal GS to the kickback compensation voltage through two steps.

Specifically, the kickback compensation signal KB provided from the timing controller 140 to the gate driving part 120 may include a first kickback compensation signal KB1 and a second compensation signal KB2. The gate driving part 120 decreases the gate signal GS from the ON voltage to a first kickback compensation voltage between the OFF voltage and the ON voltage in response to an activation of the first kickback compensation signal KB1. In addition, the gate driving part 120 decreases the gate signal GS from the first kickback compensation voltage to a second kickback compensation voltage between the OFF voltage and the first kickback compensation voltage. For example, the first kickback compensation voltage may be about 17 volts (V) and the second kickback compensation voltage may be about 12 volts (V) to about 15 volts (V).

The first kickback compensation signal KB1 and the second kickback compensation signal KB2 may be sequentially activated, and the second kickback compensation signal KB2 may be activated when the first kickback compensation signal KB1 is inactivated. The second kickback compensation signal KB2 may be inactivated in response to an inactivation of the gate clock signal CPV1.

The data driving part 130 outputs the data signal DS based on the image data DATA to the data line DL, in response to a data start signal STH and a data clock signal CPV2 provided from the timing controller 140.

The timing controller 140 receives the image data DATA and a control signal CON from an outside. The control signal CON may include a horizontal synchronous signal Hsync, a vertical synchronous signal Vsync and a clock signal CLK. The timing controller 140 generates the data start signal STH using the horizontal synchronous signal Hsync and outputs the data start signal STH to the data driving part 130. In addition, the timing controller 140 generates the gate start signal STV using the vertical synchronous signal Vsync and outputs the gate start signal STV to the gate driving part 130. In addition, the timing controller 140 generates the gate clock signal CLK1 and the data clock signal CLK2 using the clock signal CLK, and outputs the gate clock signal CLK1 to the gate driving part 120 and outputs the data clock signal CLK2 to the data driving part 130.

The display apparatus 100 may include a light source part 150 generating a light L to the display panel 110. For example, the light source part 150 may be a light emitting diode (LED).

Figure 2:
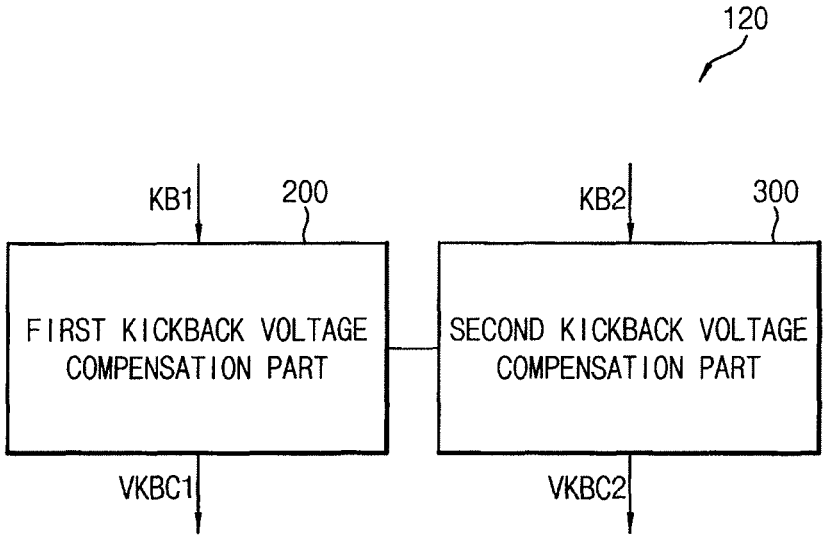
FIG. 2 is an exemplary block diagram illustrating a gate driving part of FIG. 1.
Figure 3:
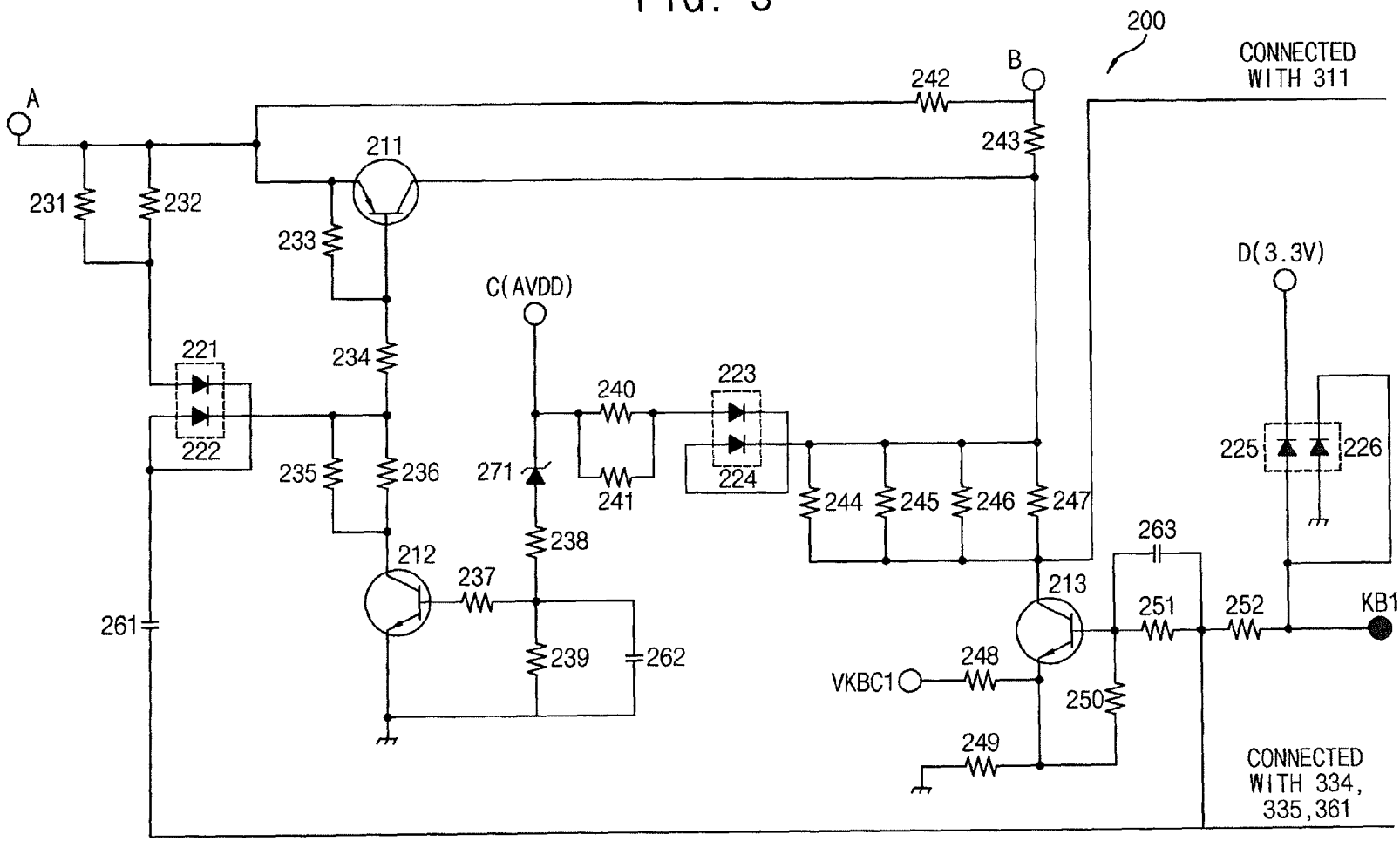
FIG. 3 is an example of a first kickback voltage compensation part in the gate driving part of FIGS. 1 and 2.
Figure 4:
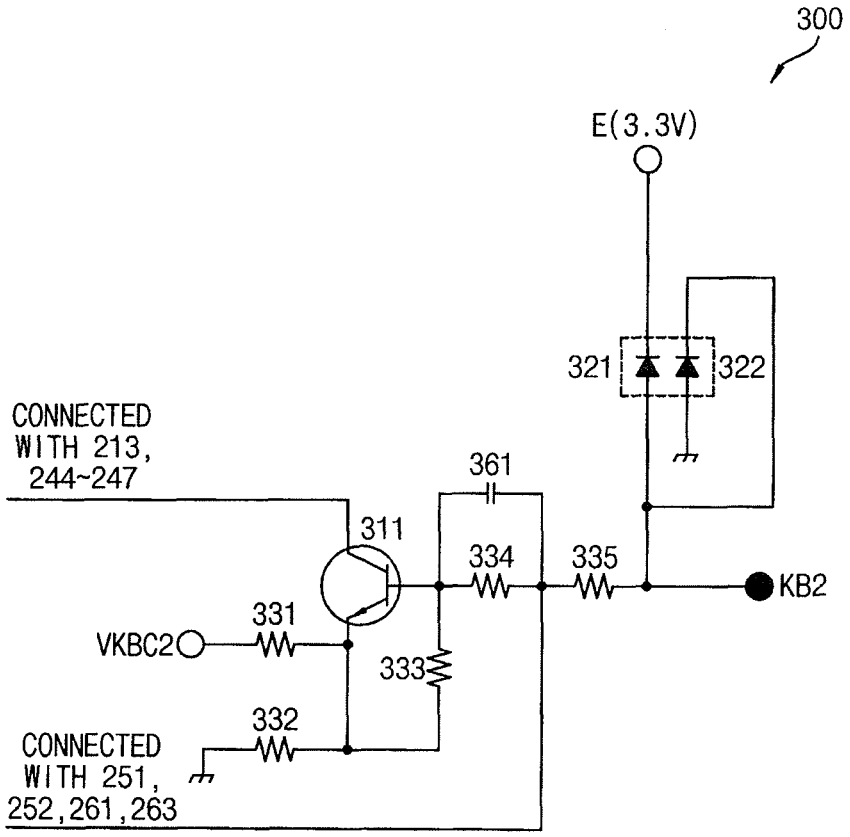
FIG. 4 is an example of a second kickback voltage compensation part in the gate driving part of FIGS. 1 and 2.

FIG. 2 is an exemplary block diagram illustrating the gate driving part 120 that can be used with apparatus shown in FIG. 1. FIG. 3 is an exemplary first kickback voltage compensation part 200 in the gate driving part 120 FIGS. 1 and 2. FIG. 4 is an exemplary second kickback voltage compensation part 300 in the gate driving part 120 that can be used with the described technology shown in FIGS. 1 and 2.

Referring to FIGS. 1 to 4, the gate driving part 120 includes the first kickback voltage compensation part 200 and the second kickback voltage compensation part 300.

The first kickback voltage compensation part 200 outputs the first kickback compensation voltage VKBC1 in response to the first kickback compensation signal KB1 provided from the timing controller 140. The second kickback voltage compensation part 300 outputs the second kickback compensation voltage VKBC2 in response to the second kickback compensation signal KB2 provided from the timing controller 140.

The first kickback voltage compensation part 200 may include transistors 211 to 213, diodes 221 to 226, resistors 231 to 252, capacitors 261 to 263 and a zener diode 271.

The transistor 211 may be a pnp type transistor, and includes an emitter electrode connected to an A voltage terminal A and the resistors 231 to 233 and 242, a base electrode connected to the resistors 233 and 234 and a collector electrode connected to the resistors 243 to 247 and the diode 224. A voltage substantially equal to the ON voltage may be applied to the A voltage terminal A. The transistor 212 may be an npn type transistor, and includes an emitter electrode connected to a ground terminal, the resistor 239 and the capacitor 262, a base electrode connected to the resistor 237 and a collector electrode connected to the resistors 235 and 236. The transistor 213 may be an npn type transistor, and includes an emitter electrode connected to the resistors 248 to 250, a base electrode connected to the capacitor 263 and a collector electrode connected to the resistors 244 to 247 and a transistor 311 of the second kickback voltage compensation part 300.

The diode 221 includes an anode electrode connected to the resistors 231 and 232, and a cathode electrode connected to the diode 222 and the capacitor 261. The diode 222 includes an anode electrode connected to the diode 221 and the capacitor 261, and a cathode electrode connected the resistors 234 to 236. The diode 223 includes an anode electrode connected to the resistors 240 and 241, and a cathode electrode connected to the diode 224. The diode 224 includes an anode electrode connected to the diode 223 and a cathode electrode connected to the resistors 243 to 247. The diode 225 includes an anode electrode connected to the diode 226, the resistor 252 and a terminal to which the first kickback compensation signal KB1 is applied. The diode 225 also includes a cathode electrode connected to a D voltage terminal D. A voltage of about 3.3 volts (V) may be applied to the D voltage terminal D. The diode 226 includes an anode electrode connected to the ground terminal and a cathode electrode connected to the diode 225, the resistor 252 and the terminal to which the first kickback compensation signal KB1 is applied.

The resistor 231 includes a first electrode connected to the A voltage terminal A, the resistors 232, 233 and 242 and the transistor 211, and a second electrode connected to the resistor 232 and the diode 221. The resistor 232 includes a first electrode connected to the A voltage terminal A, the resistors 231, 233 and 242 and the transistor 211, and a second electrode connected to the resistor 231 and the diode 221. The resistor 233 includes a first electrode connected to the A voltage terminal A, the resistors 231, 232 and 242 and the transistor 211, and a second electrode connected to the transistor 211 and the resistor 234. The resistor 234 includes a first electrode connected to the resistor 233 and the transistor 211, and a second electrode connected to the resistors 235 and 236 and the diode 222. The resistor 235 includes a first electrode connected to the resistors 234 and 236 and the diode 222, and a second electrode connected to the resistor 236 and the transistor 212. The resistor 236 includes a first electrode connected to the resistors 234 and 235 and the diode 222, and a second electrode connected to the resistor 235 and the transistor 212. The resistor 237 includes a first electrode connected to the transistor 212 and a second electrode connected to the resistors 237 to 239 and the capacitor 262. The resistor 238 includes a first electrode connected to the zener diode 271 and a second electrode connected to the resistors 237 and 239 and the capacitor 262. The resistor 239 includes a first electrode connected to the resistors 237 and 238 and the capacitor 262, and a second electrode connected to the ground terminal and the capacitor 262. The resistor 240 includes a first electrode connected to the resistor 241, C voltage terminal C and the zener diode 271, and a second electrode connected to the resistor 241 and the diode 223. An analog voltage AVDD generated from external voltage generating part (not shown) may be applied to the C voltage terminal C. The resistor 241 includes a first electrode connected to the resistor 240, the C voltage terminal C and the zener diode 271, and a second electrode connected to the resistor 240 and the diode 223. The resistor 242 includes a first electrode connected to the A voltage terminal A, the resistors 231 to 233 and the transistor 211, and a second electrode connected to a B voltage terminal B and the resistor 243. The voltage substantially equal to the ON voltage may be applied to the B voltage terminal B. The resistor 243 includes a first electrode connected to the resistor 242 and the B voltage terminal B, and a second electrode connected to the transistor 211, the resistors 244 to 247 and the diode 224. The resistor 244 includes a first electrode connected to the resistors 243 and 245 to 247 and the diode 224, and a second electrode connected to the resistors 245 to 247, the transistor 213 and the transistor 311 of the second kickback voltage compensation part 300. The resistor 245 includes a first electrode connected to the resistors 243, 244, 246 and 247 and the diode 224, and a second electrode connected to the resistors 244, 246 and 247, the transistor 213 and the transistor 311 of the second kickback voltage compensation part 300. The resistor 246 includes a first electrode connected to the resistors 243 to 245 and 247 and the diode 224, and a second electrode connected to the resistors 244, 245 and 247, the transistor 213 and the transistor 311 of the second kickback voltage compensation part 300. The resistor 247 includes a first electrode connected to the resistors 243 to 246 and the diode 224, and a second electrode connected to the transistor 213 and the transistor 311 of the second kickback voltage compensation part 300. The resistor 248 includes a first electrode connected to a terminal from which the first kickback compensation voltage VKBC1 is outputted, and a second electrode connected to the transistor 213 and the resistors 249 and 250. The resistor 249 includes a first electrode connected to the ground terminal and a second electrode connected to the resistors 248 and 250 and the transistor 213. The resistor 250 includes a first electrode connected to the transistor 213, the resistor 251 and the capacitor 263, and a second electrode connected to the resistors 248 and 249 and the transistor 213. The resistor 251 includes a first electrode connected to the resistor 250, the capacitor 263 and the transistor 213, and a second electrode connected to the resistor 252, the capacitors 261 and 263, resistors 334 and 335 of the second kickback voltage compensation part 300 and a capacitor 361 of the second kickback voltage compensation part 300. The resistor 252 includes a first electrode connected to the resistor 251, the capacitors 261 and 263, the resistors 334 and 335 of the second kickback voltage compensation part 300 and the capacitor 361 of the second kickback voltage compensation part 300. The resistor 252 also includes a second electrode connected to the terminal to which the first kickback compensation signal KB1 is applied and the diodes 225 and 226.

The capacitor 261 includes a first electrode connected to the diode 221 and a second electrode connected to the resistors 251 and 252, the capacitor 263, the resistors 334 and 335 of the second kickback voltage compensation part 300 and the capacitor 361 of the second kickback voltage compensation part 300. The capacitor 262 includes a first electrode connected to the resistors 237 to 239 and a second electrode connected to the resistor 239 and the ground terminal. The capacitor 263 includes a first electrode connected to the resistors 250 and 251 and the transistor 213, and a second electrode connected to the resistors 251 and 252, the capacitor 261, the resistors 334 and 335 of the second kickback voltage compensation part 300 and the capacitor 361 of the second kickback voltage compensation part 300. The zener diode 271 includes an anode electrode connected to the resistor 238 and a cathode electrode connected to the C voltage terminal C and the resistors 240 and 241.

The second kickback voltage compensation part 300 includes the transistor 311, diodes 321 and 322, resistors 331 to 335 and the capacitor 361.

The transistor 311 may be an npn type transistor. The transistor can also include an emitter electrode connected to the resistors 331 and 332, a base electrode connected to the resistors 333 and 334 and the capacitor 361, and a collector electrode connected to the transistor 213 of the first kickback voltage compensation part 200 and the resistors 244 to 247 of the first kickback voltage compensation part 200.

The diode 321 includes an anode electrode connected to a terminal to which the second kickback compensation signal KB2 is applied, the resistor 335 and the diode 322, and a cathode electrode connected to an E voltage terminal E. A voltage of about 3.3 volts (V) may be applied to the E voltage terminal E. The diode 322 includes an anode electrode connected to the ground terminal and a cathode electrode connected to a terminal to which the second kickback compensation signal KB2 is applied, the resistor 335 and the diode 321.

The resistor 331 includes a first electrode connected to a terminal from which the second kickback compensation voltage VKBC2 is outputted and a second electrode connected to the transistor 311 and the resistors 332 and 333. The resistor 332 includes a first electrode connected to the ground terminal and a second electrode connected to the transistor 311 and the resistors 331 and 333. The resistor 333 includes a first electrode connected to the transistor 311, the resistor 334 and the capacitor 361, and a second electrode connected to the transistor 311 and the resistors 331 and 332. The resistor 334 includes a first electrode connected to the transistor 311, the resistor 333 and the capacitor 361, and a second electrode connected to the transistor 335, the capacitor 361, the resistors 251 and 252 of the first kickback voltage compensation part 200 and the capacitors 261 and 263 of the first kickback voltage compensation part 200. The resistor 335 includes a first electrode connected to the resistor 334, the capacitor 361, the resistors 251 and 252 of the first kickback voltage compensation part 200 and the capacitors 261 and 263 of the first kickback voltage compensation part 200. The resistor 335 also includes a second electrode connected to the terminal to which the second kickback compensation signal KB2 is applied and the diodes 321 and 322.

The capacitor 361 includes a first electrode connected to the transistor 311, the resistors 333 and 334, and a second electrode connected to the resistors 334 and 335, the resistors 251 and 252 of the first kickback voltage compensation part 200 and the capacitors 261 and 263 of the first kickback voltage compensation part 200.

The voltages of the A voltage terminal A, the B voltage terminal B, the C voltage terminal C, the D voltage terminal D and the E voltage terminal E may be applied from the voltage generating part (not shown) providing a voltage to the gate driving part 120. In addition, the first kickback compensation voltage VKBC1 and the second kickback compensation voltage VKBC2 may be generated using an analog voltage and an input voltage outputted from the voltage generating part. Alternatively, the first kickback compensation voltage VKBC1 and the second kickback compensation voltage VKBC2 may be generated using a regulator. Alternatively, the first kickback compensation voltage VKBC1 and the second kickback compensation voltage VKBC2 may be generated through a resistor division method.

Figure 5:
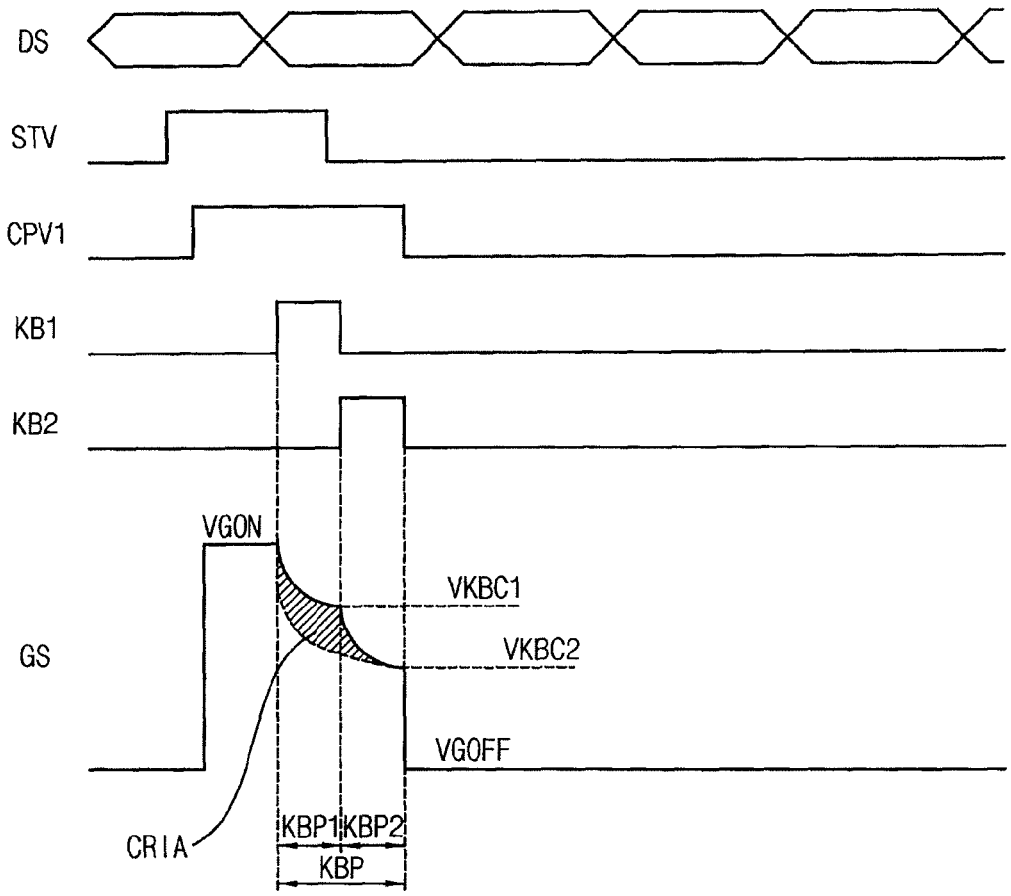
FIG. 5 is example of waveforms illustrating a data signal, a gate start signal, a gate clock signal, a first kickback compensation signal, a second kickback compensation signal and a gate signal of FIG. 1.

FIG. 5 is an exemplary waveform diagram illustrating the data signal DS, the gate start signal STV, the gate clock signal CPV1, the first kickback compensation signal KB1, the second kickback compensation signal KB2 and the gate signal GS of FIG. 1.

Referring to FIGS. 1, 2 and 5, the gate signal GS is increased from the OFF voltage VGOFF to the ON voltage VGON in response to the activations of the gate start signal STV and the gate clock signal CPV1. For example, the OFF voltage VGOFF may be about −7.5 volts (V) to about −6.5 volts (V), and the ON voltage VGON may be about 28 volts (V) to about 31 volts (V).

The first kickback compensation signal KB1 is activated before the gate clock signal CPV1 is inactivated. The gate signal GS is decreased from the ON voltage VGON to the first kickback compensation voltage VKB1 during a first kickback compensation period KBP1 of a kickback compensation period KBP in response to the activation of the first kickback compensation signal KB1. For example, the first kickback compensation voltage may be about 17 volts (V).

The gate signal GS is decreased from the first kickback compensation voltage VKB1 to the second kickback compensation voltage VKB2 during a second kickback compensation period KBP1 of the kickback compensation period KBP in response to the activation of the second kickback compensation signal KB2 following the first kickback compensation signal KB1. For example, the second kickback compensation voltage may be about 12 volts (V) to about 15 volts (V).

The second kickback compensation signal KB2 is inactivated in response to the inactivation of the gate clock signal CPV1, and the gate signal GS is decreased from the second kickback compensation voltage VKB2 to the OFF voltage VGOFF.

The gate signal GS is decreased from the ON voltage VGON to the first kickback compensation voltage VKBC1, in response to the activation of the first kickback compensation signal KB1. The gate signal GS is decreased from the first kickback compensation voltage VKBC1 to the second kickback compensation voltage VKBC2, in response to the activation of the second kickback compensation signal KB2 in the kickback compensation period KBP. Therefore the gate signal GS is decreased from the ON voltage VGON to the kickback compensation voltage through two steps. Thus, a data charging rate may be increased compared to that of conventional method that the gate signal GS is decreased from the ON voltage VGON to the kickback compensation voltage through one step. For example, an increase of the data-charging rate may correspond to a deviant crease line area CRIA.

Figure 6:
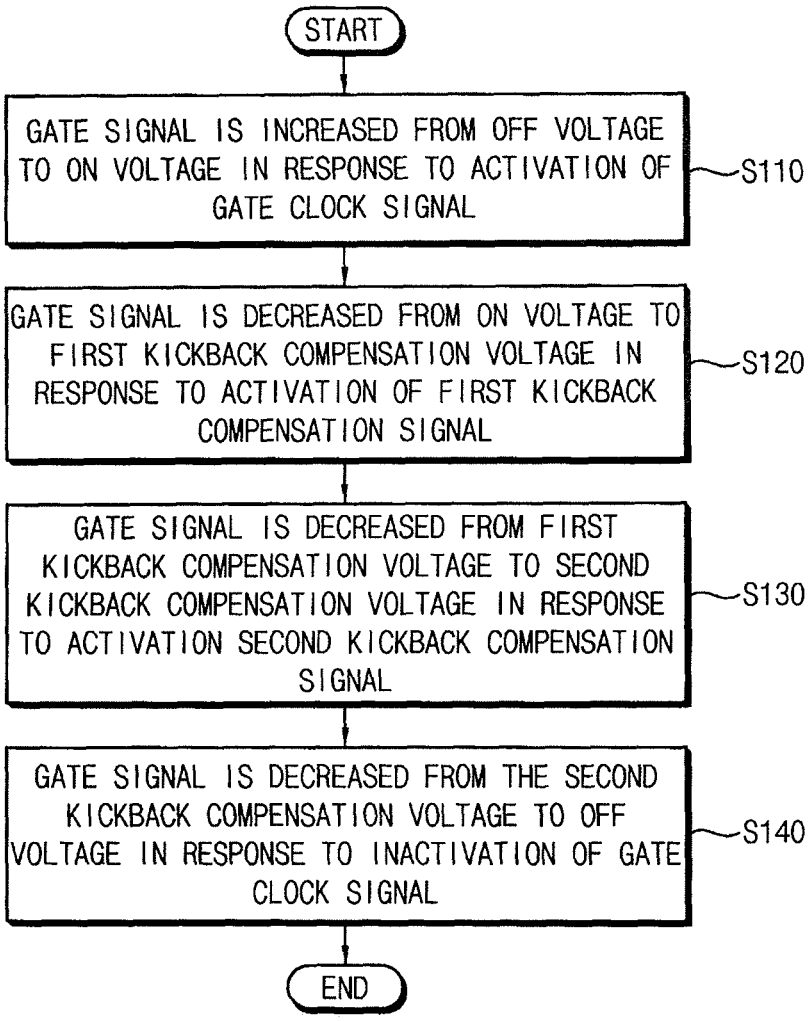
FIG. 6 is an exemplary flow chart illustrating a method of driving a display panel performed by a display panel driving apparatus of FIG. 1.

FIG. 6 is an exemplary flow chart illustrating a method of driving a display panel performed by the display panel driving apparatus 101 of FIG. 1.

Referring to FIGS. 1, 5 and 6, the gate signal GS is increased from the OFF voltage VGOFF to the ON voltage VGON in response to the activation of the gate clock signal CPV1 (step S110). Specifically, the gate driving part 120 increases the gate signal GS from the OFF voltage VGOFF to the ON voltage VGON in response to the activations of the gate start signal STV and the gate clock signal CPV1 provided from the timing controller 140. For example, the OFF voltage VGOFF may be about −7.5 volts (V) to about −6.5 volts (V), and the ON voltage VGON may be about 28 volts (V) to about 31 volts (V).

The gate signal GS is decreased from the ON voltage VGON to the first kickback compensation voltage VKBC1 in response to the activation of the first kickback compensation signal KB1 (step S120). Specifically, the gate driving part 120 decreases the gate signal GS from the ON voltage VGON to the first kickback compensation voltage VKBC1 during the first kickback compensation period KBP1 of the kickback compensation period KBP in response to the activation of the first kickback compensation signal KB1 provided from the timing controller 140. For example, the first kickback compensation voltage may be about 17 volts (V).

The gate signal GS is decreased from the first kickback compensation voltage VKBC1 to the second kickback compensation voltage VKBC2 in response to the activation of the second kickback compensation signal KB2 (step S130). Specifically, the gate driving part 120 decreases the gate signal GS from the first kickback compensation voltage VKBC1 to the second kickback compensation voltage VKBC2 during the second kickback compensation period KBP2 of the kickback compensation period KBP in response to the activation of the second kickback compensation signal KB2 provided from the timing controller 140. The first kickback compensation signal KB1 and the second kickback compensation signal KB2 may be sequentially activated, and the second kickback compensation signal KB2 may be activated when the first kickback compensation signal KB1 is inactivated.

The gate signal GS is decreased from the second kickback compensation voltage VKBC2 to the OFF voltage VGOFF in response to the inactivation of the gate clock signal CPV1 (step S140). Specifically, the second kickback compensation signal KB2 is inactivated in response to the inactivation of the gate clock signal CPV1 provided from the timing controller 140. The gate driving part 120 decreases the gate signal GS from the second kickback compensation voltage VKB2 to the OFF voltage VGOFF in response to the inactivation of the gate clock signal CPV1.

In the present example embodiment, the gate driving part 120 controls a level of the gate signal GS in response to the first kickback compensation signal KB1 and the second kickback compensation signal KB2, but it is not limited thereto. For example, the voltage generating part providing the voltage to the gate driving part 120 may control the level of the gate signal GS in response to the first kickback compensation signal KB1 and the second kickback compensation signal KB2.

According to the present example embodiment, the gate signal GS is decreased from the ON voltage VGON to the first kickback compensation voltage VKBC1 in response to the activation of the first kickback compensation signal KB1. The gate signal GS is decreased from the first kickback compensation voltage VKBC1 to the second kickback compensation voltage VKBC2 in response to the activation of the second kickback compensation signal KB2 in the kickback compensation period KBP. Therefore the gate signal GS is decreased from the ON voltage VGON to the kickback compensation voltage through two steps. Thus, the data-charging rate may be increased.

According to one method of driving the display panel, a gate signal is decreased from a ON voltage to a first kickback compensation voltage in response to an activation of a first kickback compensation signal. The gate signal is decreased from the first kickback compensation voltage to a second kickback compensation voltage in response to an activation of a second kickback compensation signal. Therefore, the gate signal is decreased from the ON voltage to a kickback compensation voltage through two steps in a kickback compensation period. Therefore, a data-charging rate may be increased, and thus a display quality of the display apparatus may be increased.

The foregoing is illustrative of the present invention and is not to be construed as limiting thereof. Although a few example embodiments of the present invention have been described, those skilled in the art will readily appreciate that many modifications are possible without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method of driving a display panel, the method comprising:

increasing a gate signal applied to a gate line from an OFF voltage to an ON voltage in response to an activation of a gate clock signal; and decreasing the gate signal from the ON voltage to at least one kickback compensation voltage between the OFF voltage and the ON voltage through a plurality of steps in response to an activation of at least one kickback compensation signal, wherein decreasing the gate signal comprises:

decreasing the gate signal from the ON voltage to a first kickback compensation voltage greater than the OFF voltage in response to a rising edge of a first kickback compensation signal; and decreasing the gate signal from the first kickback compensation voltage to a second kickback compensation voltage between the OFF voltage and the first kickback compensation voltage in response to a rising edge of a second kickback compensation signal different from the first kickback compensation signal.

2. The method of claim 1, wherein the first kickback compensation signal and the second kickback compensation signal are sequentially activated.

3. The method of claim 2, wherein the second kickback compensation signal is activated as soon as the first kickback compensation signal is inactivated.

4. The method of claim 3, wherein the second kickback compensation signal is inactivated in response to an inactivation of the gate clock signal.

5. The method of claim 1, wherein the first kickback compensation signal is activated before the gate clock signal is inactivated.

6. The method of claim 1, wherein the second kickback compensation signal remains deactivated while the gate signal is decreasing from the ON voltage to the first kickback compensation signal.

7. The method of claim 1, wherein the rising edge of the second kickback compensation signal overlaps in time a falling edge of the first kickback compensation signal.

8. The method of claim 1, wherein an activation time of the first kickback compensation signal is the same as a time during which the gate signal is decreased from the ON voltage to the first kickback compensation voltage, and an activation time of the second kickback compensation signal is the same as a time during which the gate signal is decreased from the first kickback compensation voltage to the second kickback compensation voltage.

9. A display panel driving apparatus comprising:

a gate driving part configured to i) increase a gate signal applied to a gate line from an OFF voltage to an ON voltage in response to an activation of a gate clock signal and ii) decrease the gate signal from the ON voltage to at least one kickback compensation voltage between the OFF voltage and the ON voltage through a plurality of steps in response to an activation of at least one kickback compensation signal, wherein the gate driving part comprises a first kickback voltage compensation part configured to decrease the gate signal from the ON voltage to a first kickback compensation voltage greater than the OFF voltage in response to a rising edge of a first kickback compensation signal and a second kickback voltage compensation part configured to decrease the gate signal from the first kickback compensation voltage to a second kickback compensation voltage between the OFF voltage and the first kickback compensation voltage in response to a rising edge of a second kickback compensation signal different from the first kickback compensation signal; and a data driving part configured to apply a data signal to a data line.

10. The display panel driving apparatus of claim 9, wherein the first kickback compensation signal and the second kickback compensation signal are further configured to be sequentially activated.

11. The display panel driving apparatus of claim 10, wherein the second kickback compensation signal is further configured to be activated as soon as the first kickback compensation signal is inactivated.

12. The display panel driving apparatus of claim 11, wherein the second kickback compensation signal is inactivated in response to an inactivation of the gate clock signal.

13. The display panel driving apparatus of claim 9, further comprising:

a timing controller configured to output the gate clock signal, the first kickback compensation signal and the second kickback compensation signal.

14. The display panel driving apparatus claim 9, wherein the first kickback compensation signal is activated before the gate clock signal is inactivated.

15. A display apparatus comprising:

a display panel configured to receive a data signal to display an image; and a display panel driving apparatus comprising i) a gate driving part configured to a) increase a gate signal applied to a gate line from an OFF voltage to an ON voltage in response to an activation of a gate clock signal and b) decrease the gate signal from the ON voltage to at least one kickback compensation voltage between the OFF voltage and the ON voltage through a plurality of steps in response to an activation of at least one kickback compensation signal, and ii) a data driving part configured to apply a data signal to a data line of the display panel, wherein the gate driving part comprises:

a first kickback voltage compensation part configured to decrease the gate signal from the ON voltage to a first kickback compensation voltage greater than the OFF voltage in response to a rising edge of a first kickback compensation signal; and a second kickback voltage compensation part configured to decrease the gate signal from the first kickback compensation voltage to a second kickback compensation voltage between the OFF voltage and the first kickback compensation voltage in response to a rising edge of a second kickback compensation signal different from the first kickback compensation signal.

16. A display panel driving apparatus comprising:

a gate driving part configured to decrease a gate signal from an ON voltage to at least one kickback compensation voltage between an OFF voltage and the ON voltage through a plurality of steps in response to an activation of at least one kickback compensation signal, wherein the gate driving part comprises a first kickback voltage compensation part configured to decrease the gate signal from the ON voltage to a first kickback compensation voltage greater than the OFF voltage in response to a rising edge of a first kickback compensation signal and a second kickback voltage compensation part configured to decrease the gate signal from the first kickback compensation voltage to a second kickback compensation voltage between the OFF voltage and the first kickback compensation voltage in response to a rising edge of a second kickback compensation signal different from the first kickback compensation signal.

* * * * *